US010044120B2

(12) United States Patent
Wang et al.

(10) Patent No.: US 10,044,120 B2
(45) Date of Patent: Aug. 7, 2018

(54) CONNECTOR

(71) Applicant: SHENZHEN SHENTAI WEIXIANG ELECTRONICS CO., LTD., Shenzhen (CN)

(72) Inventors: Jian Wang, Shenzhen (CN); Ping Chen, Shenzhen (CN)

(73) Assignee: SHENZHEN SHENTAI WEIXIANG ELECTRONICS CO., LTD., Shenzhen (CN)

( * ) Notice: Subject to any disclaimer, the term of this patent is extended or adjusted under 35 U.S.C. 154(b) by 44 days.

(21) Appl. No.: 15/116,483

(22) PCT Filed: Jul. 12, 2016

(86) PCT No.: PCT/CN2016/089816
§ 371 (c)(1),
(2) Date: Aug. 3, 2016

(87) PCT Pub. No.: WO2017/201834
PCT Pub. Date: Nov. 30, 2017

(65) Prior Publication Data

US 2017/0373413 A1 Dec. 28, 2017

(30) Foreign Application Priority Data

May 27, 2016 (CN) ..... 2016 1 0368104

(51) Int. Cl.
*H01R 12/58* (2011.01)
*H01R 12/62* (2011.01)

(52) U.S. Cl.
CPC ..... *H01R 12/585* (2013.01); *H01R 12/62* (2013.01)

(58) Field of Classification Search
CPC .... H01R 12/716; H01R 24/64; H01R 13/514; H01R 12/724; H01R 2201/04;
(Continued)

(56) References Cited

U.S. PATENT DOCUMENTS 6,293,826 B1 9/2001 Shi et al.
6,623,310 B1 * 9/2003 Billman ..... H01R 13/514 439/701
(Continued)

FOREIGN PATENT DOCUMENTS

CN 2507156 8/2002
CN 102683929 A 9/2012
(Continued)

OTHER PUBLICATIONS

ISR of PCT/CN2016/089816 dated Jan. 25, 2017.
(Continued)

*Primary Examiner* — Truc Nguyen
(74) *Attorney, Agent, or Firm* — Platinum Intellectual Property LLP

(57) ABSTRACT

The present invention relates to a connector. Aforementioned connector includes a first connecting member, a second connecting member, and a third connecting member. The first connecting member includes a first case, a first insulator, and a first conductive terminal, wherein the first case defines a first receiving chamber therein, the first insulator is received in the first receiving chamber, an external sidewall of the first case is provided with a first step. The second case defines a containing hole, the PCB board is received in the containing hole, a first end and a second end of the second case each defines a latching groove, the latching grooves is in communication with the containing hole. The third connecting member includes a third case, a second insulator, and a second conductive terminal, wherein the third case defines a second receiving chamber therein. In above connector, because the electrical components coupled to opposite ends of the connector can slide along three directions which are perpendicular to each other, such that a problem of a difficulty of a connection between the connector and the electrical components which is caused by a
(Continued)

deviation of the design of the structure of the electrical components can be avoided, thereby a tolerance insensitive of the connector is enhanced.

11 Claims, 8 Drawing Sheets

(58) Field of Classification Search
CPC ..... H01R 43/0256; H01R 13/641; H01R 13/6658; H01R 13/7175; H01R 12/7005; H01R 12/714; H01R 13/03; H01R 13/2442; H01R 12/57
See application file for complete search history.

(56) References Cited

U.S. PATENT DOCUMENTS 6,695,622 B2 * 2/2004 Korsunsky ..... H01R 31/06 439/631
7,481,679 B1 * 1/2009 Stotz ..... H01R 12/7029 439/638
7,494,383 B2 * 2/2009 Cohen ..... H01R 13/6658 439/638
7,637,784 B2 * 12/2009 Evans ..... H01R 31/065 439/638
8,740,643 B2 * 6/2014 Kuang ..... H01R 12/721 439/541.5
9,306,336 B2 * 4/2016 Chang ..... H01R 13/6471
2016/0006191 A1 * 1/2016 Leibold ..... H01R 12/724 439/660

FOREIGN PATENT DOCUMENTS

CN 202444086 U 9/2012
CN 204696287 U 10/2015
CN 205029062 U 2/2016
CN 205790554 U 12/2016

OTHER PUBLICATIONS

SIPO Office Action of corresponding Chinese patent application dated Jul. 12, 2017.
Taiwanese Office Action of corresponding patent application in Taiwan dated Aug. 15, 2017.

* cited by examiner

CONNECTOR

FIELD OF THE INVENTION

The present invention relates to a technical field of electronic devices, and more particular relates to a connector.

BACKGROUND OF THE INVENTION

Connector is a commonly used component in communication equipment. Opposite ends of the common connector are connected to two electrical components respectively. When a design deviation of the electrical component emerges, the connector is difficult to connect with the electrical component. At the time, even though the electrical component is connected to the connector, a relative greater stress is generated, and an electrical performance is greatly influenced, therefore, a tolerance insensitive is poor.

SUMMARY OF THE INVENTION

Accordingly, it is necessary to provide a connector directed to solve a problem of a poor tolerance insensitive of the connector.

A connector includes:

a first connecting member including a first case, a first insulator, and a first conductive terminal, wherein the first case defines a first receiving chamber therein, the first insulator is received in the first receiving chamber, and the first conductive terminal is received in the first insulator, an external sidewall of the first case is provided with a first step on an external sidewall thereof;

a second connecting member including a second case and a PCB board, wherein the second case defines a containing hole, the PCB board is received in the containing hole, a first end and a second end of the second case each defines a latching groove, the latching grooves is in communication with the containing hole, opposite ends of the PCB board are provided with a first contact sheet and a second contact sheet, the first step is received in the latching groove of the first end, the first conductive terminal resists the first contact sheet, and the first conductive terminal is capable of sliding along a first direction on the first contact sheet; and a third connecting member including a third case, a second insulator, and a second conductive terminal, wherein the third case defines a second receiving chamber therein, the second insulator is received in the second receiving chamber, and the second conductive terminal is received the second insulator, an external sidewall of the third case is provided with a second step, the second step is received in the latching groove of the second end, and the second conductive terminal resists the second contact sheet, and the second conductive terminal is capable of sliding along a second direction on the second contact sheet, the third connecting member is capable of sliding along a third direction on the second case.

In aforementioned connector of the embodiment, the first step is received in the latching groove of the first end, and the first conductive terminal resists the first contact sheet. When the first conductive terminal slides along the first direction on the first contact sheet, the first connecting member slides along the first direction relative to the second connecting member. The second step is received in the latching groove of the second end, and the second conductive terminal resists the second contact sheet. When the second conductive terminal slides along the second direction on the second contact sheet, the third connecting member slides along the second direction relative to the second connecting member. The third connecting member can slide along the third direction on the second case. Because the electrical components coupled to opposite ends of the connector can slide along three directions which are perpendicular to each other, i.e. deviations in the design of the structure of the electrical components on opposite ends of the connector are allowed, such that a problem of a difficulty of a connection between the connector and the electrical components which is caused by a deviation of the design of the structure of the electrical components can be avoided, thereby a tolerance insensitive of the connector is enhanced.

According to one embodiment, the connector further includes a third conductive terminal, a fourth conductive terminal, and a third contact sheet:

wherein the first insulator includes a first portion and a second portion, the first portion is plugged to the second portion, the first conductive terminal is received in the first portion, the third conductive terminal is received in the second portion;

the second insulator includes a third portion and a fourth portion, the third portion is plugged to the fourth portion, the second conductive terminal is received the third portion, the third conductive terminal is received the fourth portion; and the third contact sheet is positioned on the PCB board, the first contact sheet, the second contact sheet, and the third contact sheet are positioned on a same side surface of the PCB board, and separation distances are provided between the first contact sheet and the third contact sheet, between the second contact sheet and the third contact sheet, the third conductive terminal and the fourth conductive terminal both resist the third contact sheet.

According to one embodiment, a number of the third contact sheet is two, the two third contact sheets are positioned on opposite sides of the PCB board, respectively;

the third conductive terminal includes two first terminal units positioned on the second portion and opposite to each other, the two first terminal units clamp the PCB board, and the two first terminal units resist the two third contact sheets correspondingly;

the fourth conductive terminal includes two second terminal units positioned on the fourth portion and opposite to each other, the two second terminal units clamp the PCB board, and the two second terminal units resist the two third contact sheets correspondingly.

According to one embodiment, a number of the first portions, the first conductive terminals, the third conductive terminals, and the second portions each is more than two, the plurality of first conductive terminals are received in the plurality of first portions correspondingly, the plurality of first portions are plugged to the plurality of second portions correspondingly, the plurality of third conductive terminals is received in the plurality of second portions correspondingly, the plurality of second portions are received in the first receiving groove side by side;

a number of the first contact sheets is more than two, the plurality of first contact sheets is arranged along a first direction and spaced from each other, the plurality of first conductive terminals resists the plurality of first contact sheets correspondingly, the plurality of third conductive terminals and the plurality of first conductive terminals are alternatively arranged, and the plurality of third conductive terminals resists the third contact sheet;

a number of the third portions, the second conductive terminals, the fourth conductive terminals, and the fourth portions each is more than two, the plurality of second conductive terminals is received in the plurality of third portions, the plurality of third portions is plugged to the plurality of fourth portions, the plurality of fourth conductive terminals is received in the plurality of fourth portions correspondingly, the plurality of fourth portions is received in the second receiving chamber side by side;

a number of the second conductive sheets is more than two, the plurality of second conductive sheets is arranged along the first direction and spaced from each other, the plurality of second conductive terminals resists the plurality of second contact sheets correspondingly, the plurality of fourth conductive terminals and the plurality of second conductive terminals are alternatively arranged, the plurality of fourth conductive terminals resists the third contact sheet.

According to one embodiment, the connector further includes a first conductive sheet and a second conductive sheet, wherein the first conductive sheet is positioned on the second portion, and the plurality of third conductive terminals are electrically coupled to the first conductive sheet, the second conductive sheet is positioned on the fourth portion, and the plurality of fourth conductive terminals are electrically coupled to the second conductive sheet.

According to one embodiment, the connector further includes a first shielding sheet and a second shielding sheet; wherein the first portion defines a first groove, the second portion defines a second groove, the first shielding sheet is received in the first groove and the second groove respectively;

the third portion defines a third groove, the fourth portion defines a fourth groove, the second shielding sheet is received in the third groove and the fourth groove respectively.

According to one embodiment, a slidable displacement of the first conductive terminal along the first direction on the first contact sheet is denoted as S, 0.5 millimeters≤S≤1 millimeters.

According to one embodiment, a cross section of the containing hole has a shape which shrinks from opposite ends toward a middle portion.

According to one embodiment, a slidable displacement of the third connecting member along the third direction on the second case is denoted as d, 0.5 millimeters≤d≤1 millimeters.

According to one embodiment, a slidable displacement of the second conductive terminal along the second direction on the second contact sheet is denoted as L, 1.0 millimeters≤L≤3 millimeters.

DETAILED DESCRIPTION OF THE EMBODIMENTS

Embodiments of the invention are described more fully hereinafter with reference to the accompanying drawings, in which preferred embodiments of the connector are shown. The various embodiments of the connector may, however, be embodied in many different forms and should not be construed as limited to the embodiments set forth herein. Rather, these embodiments are provided so that this disclosure will be thorough and complete, and will fully convey the scope of the connector to those skilled in the art.

Unless otherwise defined, all terms used herein have the same meaning as commonly understood by one of ordinary skill in the art to which this invention belongs. Terms in the description of the connector are for the purpose of describing specific embodiments, and are not intend to limit the invention. As used herein, the term "and/or" includes any and all combinations of one or more of the associated listed items.

Figure 1:
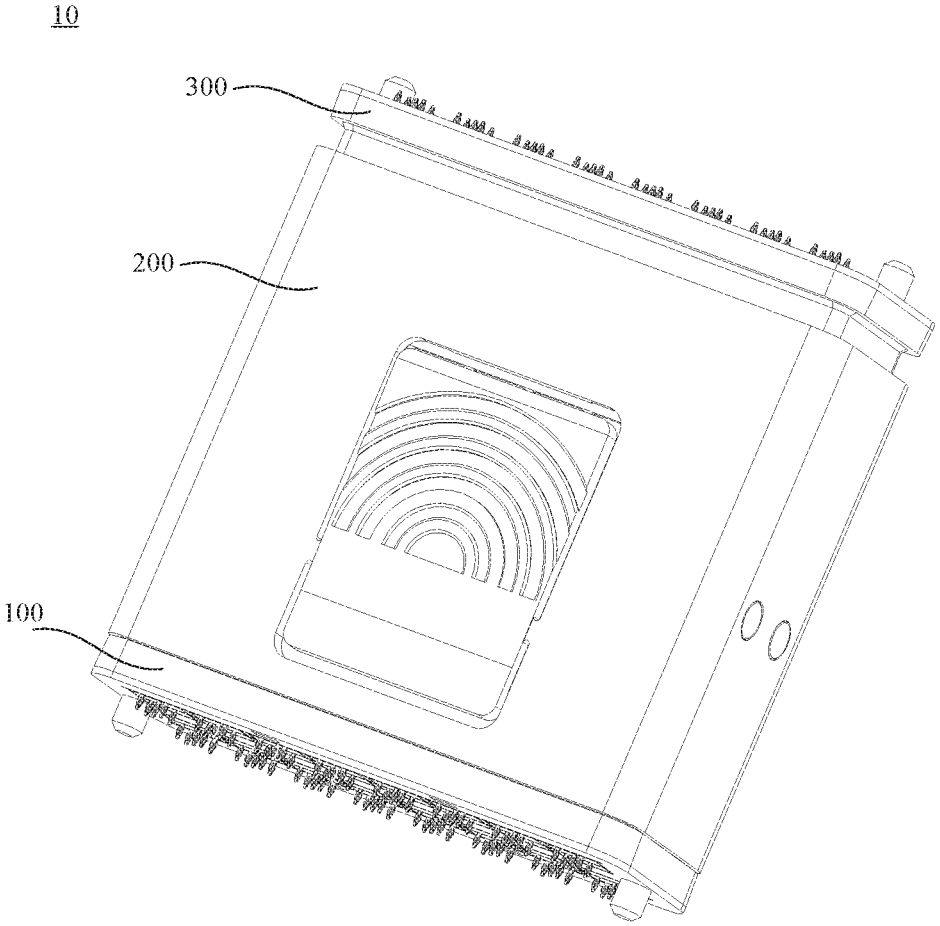
FIG. 1 is a perspective view of a connector according to an embodiment.
Figure 2:
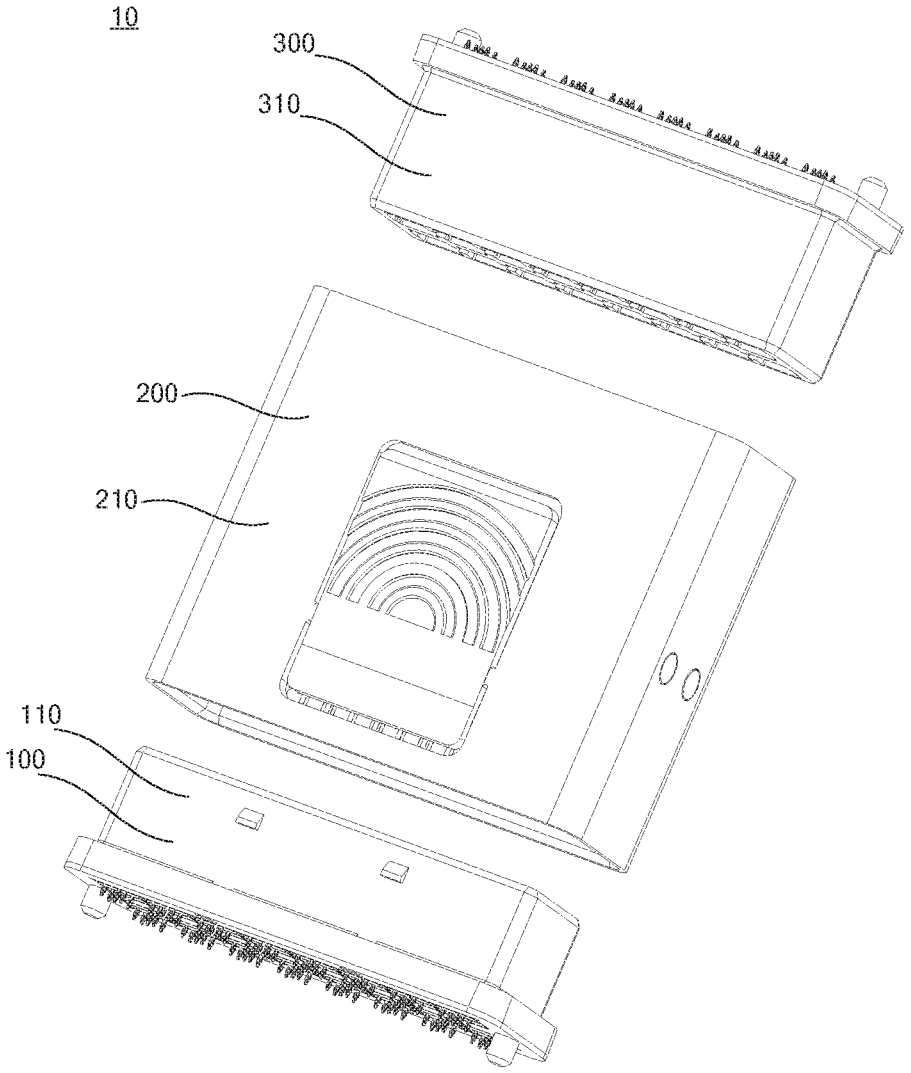
FIG. 2 is an exploded view of the connector of FIG. 1.
Figure 3:
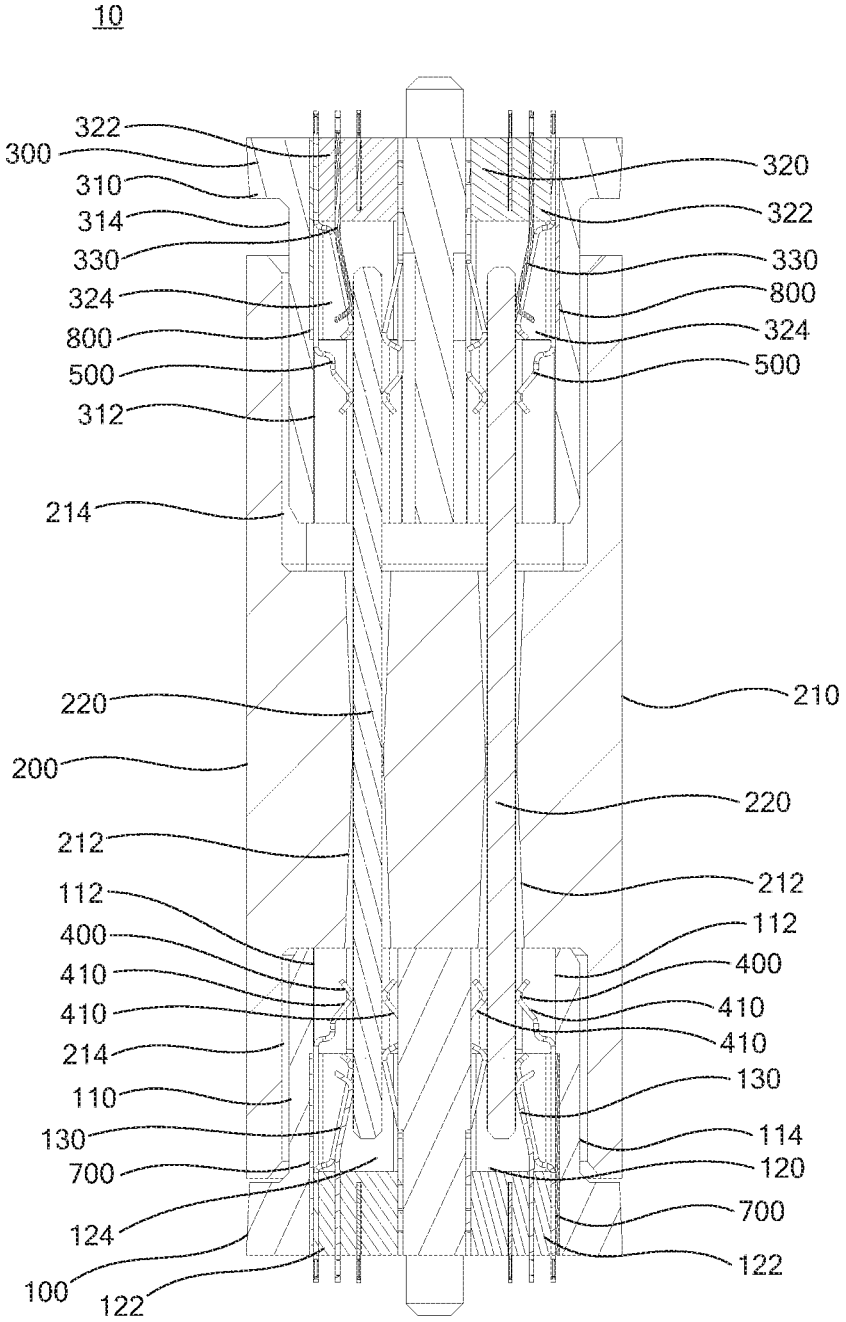
FIG. 3 is a cross-sectional view of the connector of FIG. 1.
Figure 4:
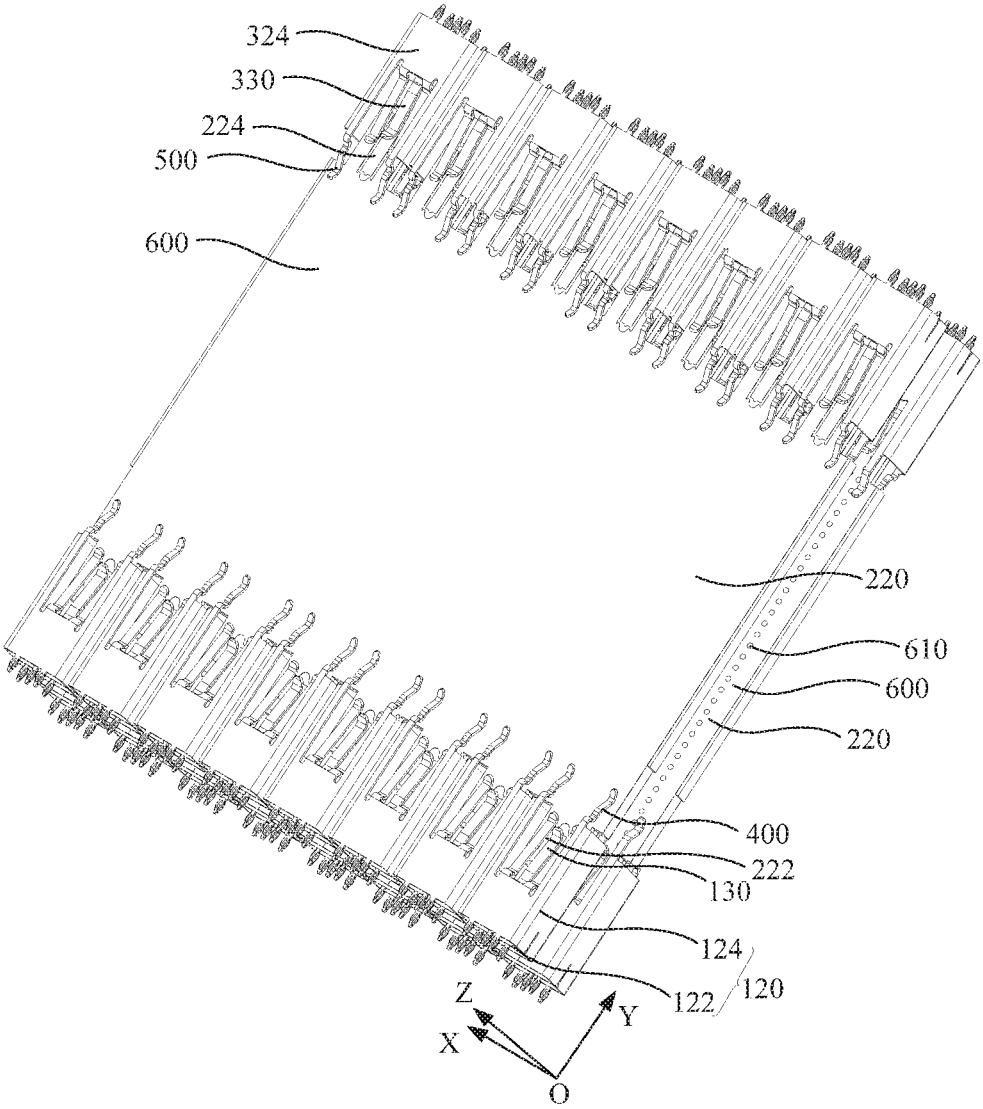
FIG. 4 is another perspective view of the connector of FIG. 1 (with the first case, the second case and the third case being removed)
Figure 5:
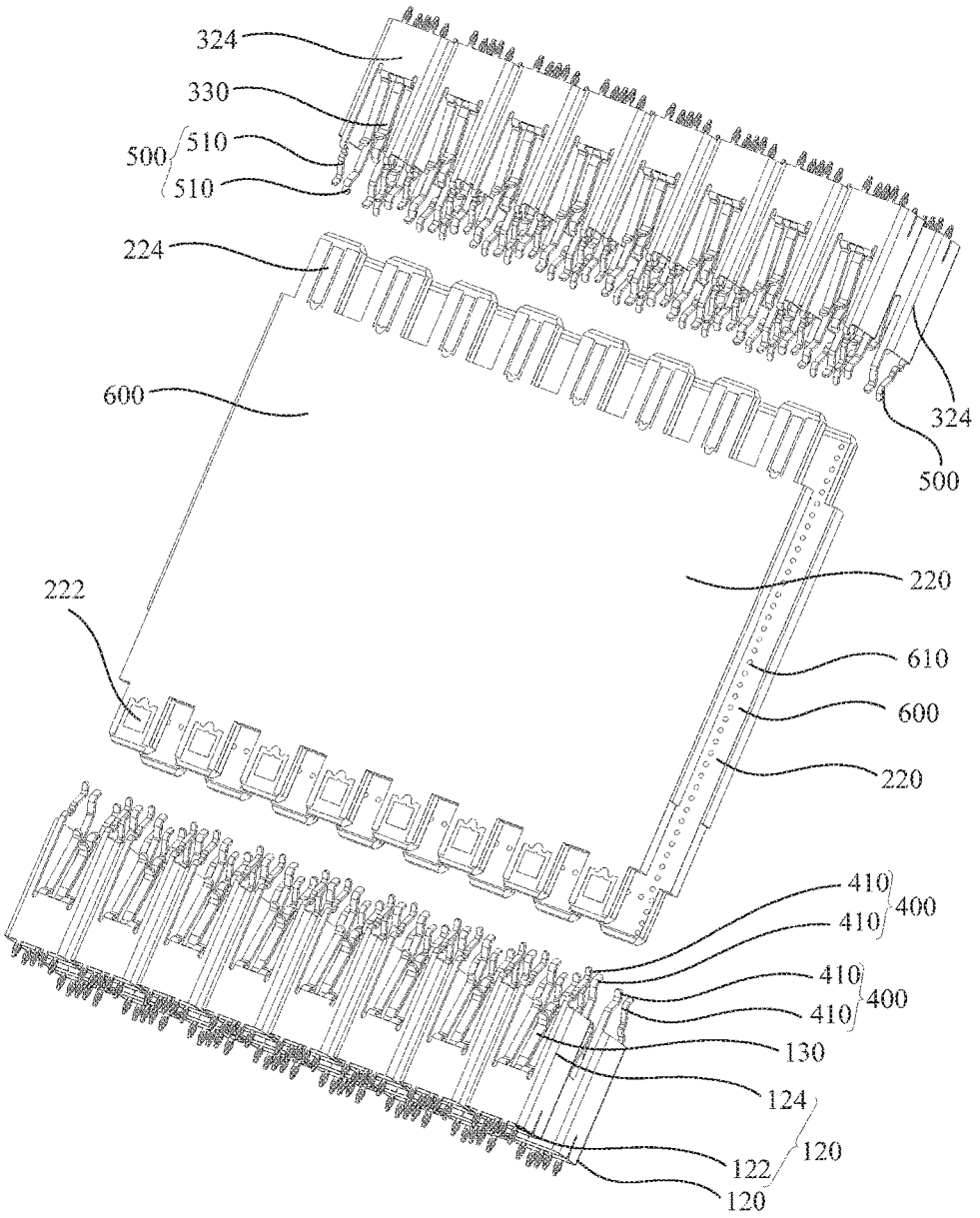
FIG. 5 is an exploded view of the connector of FIG. 4.

As shown in FIG. 1, a connector 10 according to an embodiment is gusset plate connector with a floating tolerance insensitive. As shown in FIG. 2, the connector 10 includes a first connecting member 100, a second connecting member 200 and a third connecting member 300. As shown in FIG. 3, the first connecting member 100 includes a first case 110, a first insulator 120, and a first conductive terminal 130, the first case 110 defines a first receiving chamber 112 therein, the first insulator 120 is received in the first receiving chamber 112, and the first conductive terminal 130 is received in the first insulator 120. An external sidewall of the first case 110 is provided with a first step 114. The second connecting member 200 includes a second case 210 and a PCB board 220, the second case 210 defines a containing hole 212, the PCB board 222 is received in the containing hole 212. A first end and a second end of the second case 210 each defines a latching groove 214, the latching grooves 214 are in communication with the containing hole 212. As shown in FIG. 4 and FIG. 5, opposite ends of the PCB board 220 are provided with a first contact sheet 222 and a second contact sheet 224. Referring to FIG. 3 again, the first step 114 is received in the latching groove 214 of the first end. As shown in FIG. 4, the first conductive terminal 130 resists the first contact sheet 222, and the first conductive terminal 130 is capable of sliding along a first direction on the first contact sheet 222.

As shown in FIG. 3, the third connecting member 300 includes a third case 310, a second insulator 320, and a second conductive terminal 330, the third case 310 defines a second receiving chamber 312 therein, the second insulator 320 is received in the second receiving chamber 312, and the second conductive terminal 330 is received in the second insulator 320. An external sidewall of the third case 310 is provided with a second step 314, the second step 314 is received in the latching groove 214 of the second end, also referring to FIG. 4, the second conductive terminal 330 resists the second contact sheet 224, and the second conductive terminal 330 is capable of sliding along a second direction on the second contact sheet 224. The third connecting member 300 is capable of sliding along a third direction on the second case 210. As shown in FIG. 2, in the embodiment, an end of the first connecting member 100 is coupled to a first electrical component (not shown), the other end is coupled to the second connecting member 200. An end of the third connecting member 300 is coupled to the second connecting member 200, the other end is coupled to a second electrical component (not shown). The first connecting member 100 is a fixed connecting member, the second connecting member 200 is an intermediate connecting member, the third connecting member 300 is a slidable connecting member. Outer shapes of the first case 110, the second case 210 and the third case 310 are cuboids. As shown in FIG. 3, an external side of the first case 110 which is coupled to the second case 210 is provided with the first step 114. An external side of the third case 310 which is coupled to the second case 210 is provided with the second step 314. A first end and a second end of the second case 210 defines a latching groove 214, the first step 114 is received in the latching groove 214 of the first end, the second step 314 is received in the latching groove 214 of the second end. The second case 210 defines a containing hole 212 for receiving the PCT board 220. The containing hole 212 is in communication with the latching grooves 214 of the two ends respectively.

As shown in FIG. 5, the PCB board 220 is a relative thinner flat board. A surface of a first end of the PCB board 220 is provided with the first contact sheet 222, a surface of a second end is provided with a second contact sheet 224. A width of the first contact sheet 222 is greater than a width of the second contact sheet 224, a length of the first contact sheet 222 is less than a length of the second contact sheet 224. As shown in FIG. 4, the first conductive terminal 130 and the second conductive terminal 330 both are signal terminals. The first conducive terminal 130 resists the first contact sheet 222, the second conducive terminal 330 resists the second contact sheet 224. A surface of the PCB board 220 is a flat surface, a direction oriented from a first edge of the PCB board 220 to a second edge is defined as the second direction, i.e. the Z axis direction. A direction parallel to the first edge of the PCB board 220 is defined as the first direction, i.e. the X axis direction. A direction perpendicular to the surface of the PCB board 220 is defined as the third direction, i.e. the Y axis direction. The first contact sheet 222 extends along a direction parallel to the X axis direction, the second contact sheet 224 extends along a direction parallel to the Z axis direction. The first conductive terminal 130 is capable of sliding along a direction parallel to the X axis direction, to enable the second connecting member 200 to sliding along the X axis direction relative to the first connecting member 100. The second conductive terminal 330 is capable of sliding along a direction parallel to the Z axis direction, to enable the third connecting member 300 to sliding along the Z axis direction relative to the second connecting member 200. Further, the third connecting member 300 is capable of sliding along the third direction on the second case 210, i.e. the third connecting member 300 is capable of sling along the Y axis direction relative to the first connecting member 100. Specifically, in the embodiment, the first direction, the second direction, and the third direction are perpendicular to each other.

In the connector 10 of the embodiment, the first step 114 is received in the latching groove 214 of the first end, and the first conductive terminal 130 resists the first contact sheet 222. When the first conductive terminal 130 slides along the first direction on the first contact sheet 222, the first connecting member 100 slides along the first direction relative to the second connecting member 200. The second step 314 is received in the latching groove 214 of the second end, and the second conductive terminal 330 resists the second contact sheet 224. When the second conductive terminal 330 slides along the second direction on the second contact sheet 224, the third connecting member 100 slides along the second direction relative to the second connecting member 200. The third connecting member 300 can slide along the third direction on the second case 210. Because the electrical components coupled to opposite ends of the connector 10 can slide along three directions which are perpendicular to each other, i.e. deviations in the design of the structure of the electrical components on opposite ends of the connector 10 are allowed, such that a problem of a difficulty of a connection between the connector 10 and the electrical components which is caused by a deviation of the design of the structure of the electrical components can be avoided, thereby a tolerance insensitive of the connector 10 is enhanced.

Figure 6:
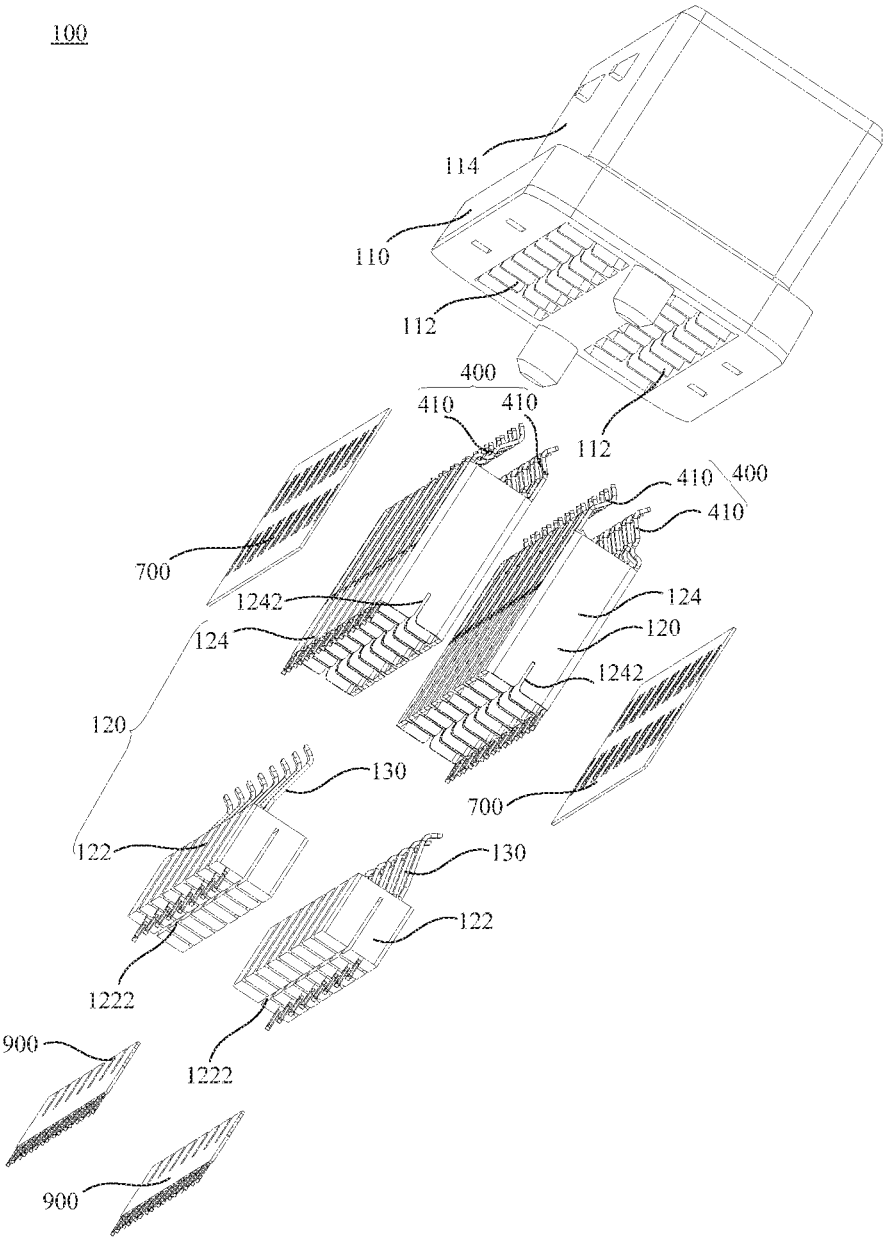
FIG. 6 is an exploded view of a first connecting member of the connector of FIG. 1.
Figure 7:
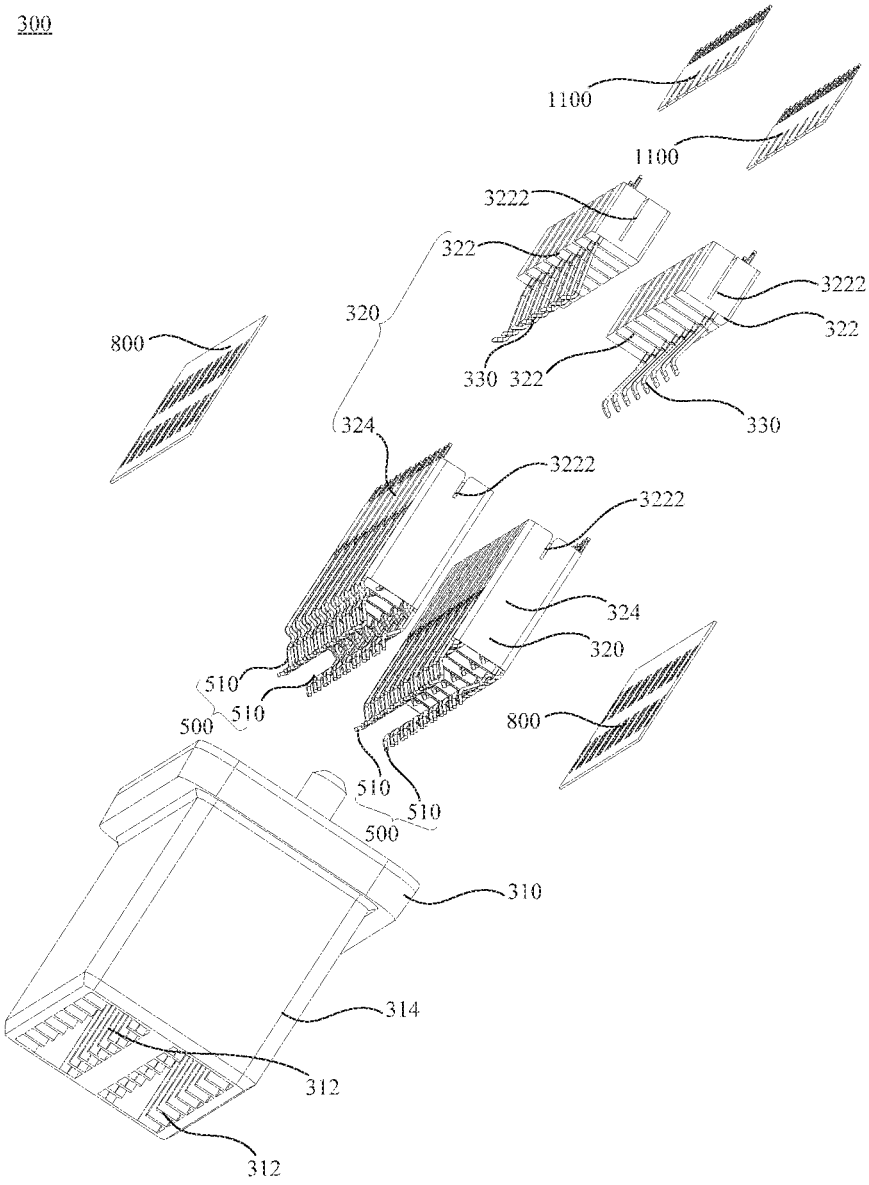
FIG. 7 is an exploded view of a third connecting member of the connector of FIG. 1.
Figure 8:
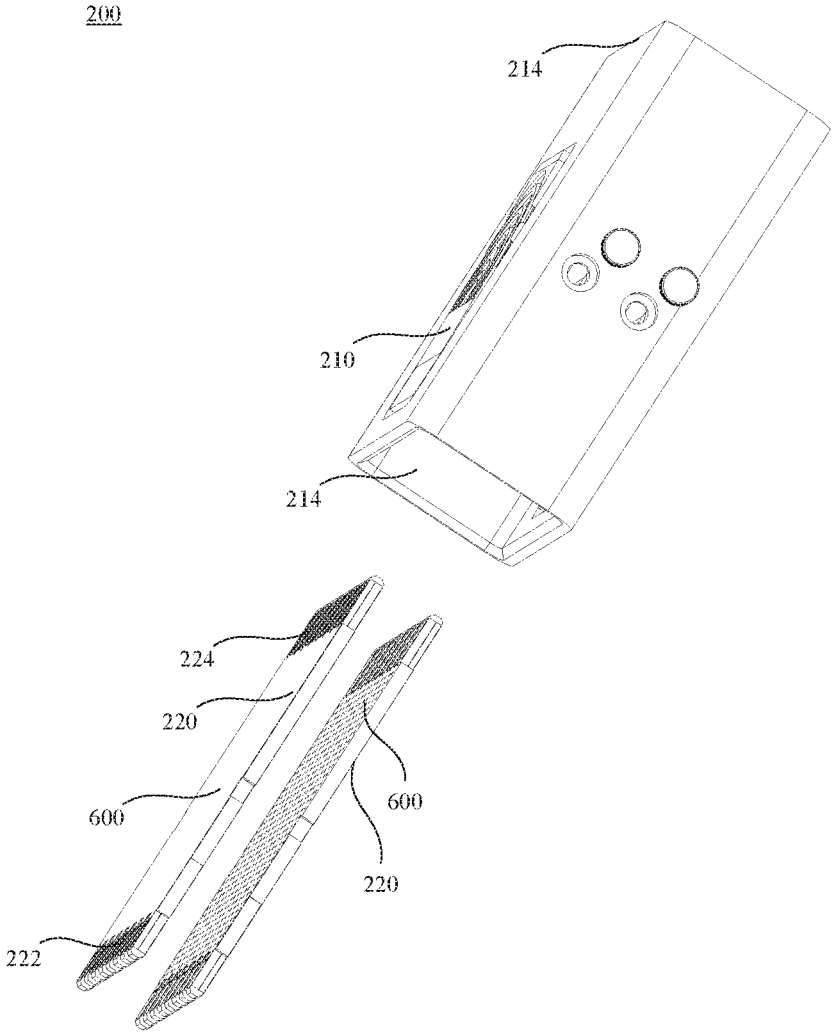
FIG. 8 is an exploded view of a second connecting member of the connector of FIG. 1.

As shown in FIG. 5, in one embodiment, the connector 10 further includes a third conductive terminal 400, a fourth conductive terminal 500, and a third contact sheet 600. As shown in FIG. 6, the first insulator 120 includes a first portion 122 and a second portion 124, the first portion 122 is plugged to the second portion 124, the first conductive terminal 130 is received in the first portion 122, the third conductive terminal 400 is received in the second portion 124. As shown in FIG. 7, the second insulator 320 includes a third portion 322 and a fourth portion 324, the third portion 322 is plugged to the fourth portion 324. The second conductive terminal 330 is received the third portion 322, the third conductive terminal 500 is received in the fourth portion 324. As shown in FIG. 8, the third contact sheet 600 is positioned on the PCB board 220, the first contact sheet 222, the second contact sheet 224, and the third contact sheet 600 are all positioned on a same side surface of the PCB board 220. Referring to FIG. 5 again, separation distances are provided between the first contact sheet 222 and the third contact sheet 600, between the second contact sheet 224 and the third contact sheet 600. Referring to FIG. 4 again, the third conductive terminal 400 and the fourth conductive terminal 500 both resist the third contact sheet 600. In the embodiment, as shown in FIG. 6, the first conductive terminal 130 and the first portion 122 are integrally formed, the third conductive terminal 400 and the second portion 124 are integrally formed. As shown in FIG. 7, the second conductive terminal 330 and the third portion 322 are integrally formed, the fourth conductive terminal 500 and the fourth portion 324 are integrally formed.

As shown in FIG. 5, in one embodiment, a number of the third contact sheet 600 is two, the two third contact sheets 600 are positioned on opposite sides of the PCB board 220 respectively. The third conductive terminal 400 includes two first terminal units 410 positioned on the second portion 124 and opposite to each other. The two first terminal units 410 clamp the PCB board 220, and the two first terminal units 410 resist the two third contact sheets 600 correspondingly. The fourth conductive terminal 500 includes two second terminal units 510 positioned on the fourth portion 324 and opposite to each other. The two second terminal units 510 clamp the PCB board 220, and the two second terminal units 510 resist the two third contact sheets 600 correspondingly. The two first terminal units 410 and the two second terminal units 510 both clamp the PCB board 220. When the third connecting member 300 slides along a direction parallel to a thickness direction of the second case 210, the third conductive terminal 400 and the fourth conductive terminal 500 can maintain a reliable contact with the third contact sheet 600 on the PCB board 200, thereby ensuring a closed transmission of the signal.

In the embodiment, the third conductive terminal 400 and the fourth conductive terminal 500 both are ground terminals, as shown in FIG. 6, the third conductive terminal 400 includes two first terminal units 410. As shown in FIG. 7, the fourth conductive terminal 500 includes two second terminal units 510. Each first terminal unit 410 and each second terminal unit 510 includes a fixing portion and a resisting portion. As shown in FIG. 6, the second portion 124 has a cuboids shape, and the second portion 124 defines a gate groove for receiving the first portion 122. The two first terminal units 410 are positioned on the top and the bottom of the second portion 124. The fixing portion of the two first terminal units 410 and the second portion 124 are integrally formed. The resisting portions of the two first terminal units 410 each has a bent shape, and the resisting portions of the two first terminal units 410 resist opposite sides of the PCB board 220, to enable the two first terminal units 410 to clamp the PCB board 220, and the two first terminal units 410 resist the third contact sheets 600 on opposite sides of the PCB board 220. As shown in FIG. 7, the fourth portion 324 has a cuboids shape, and the fourth portion 324 defines a gate groove for receiving the third portion 322. The two second terminal units 510 are positioned on the top and the bottom of the fourth portion 324. The fixing portion of the two second terminal units 510 and the fourth portion 324 are integrally formed. The resisting portions of the two second terminal units 510 each has a bent shape, and the resisting portions of the two second terminal units 510 resist opposite sides of the PCB board 220, to enable the two second terminal units 510 to clamp the PCB board 220, and the two second terminal units 510 resist the third contact sheets 600 on opposite sides of the PCB board 220, and cause the third conductive terminal 400 and the fourth conductive terminal 500 to reliability contact the third contact sheet 600. As shown in FIG. 5, a first side surface of the PCB board 220 is provided with a first contact sheet 222, a second contact sheet 224 and one third contact sheet 600, a second side surface is provided with another one third contact sheet 600. A surface of the third contact sheet 600 defines a plurality of vias 610.

As shown in FIG. 6, in one embodiment, a number of the first portion 122, the first conductive terminal 130, the third conductive terminal 400, and the second portion 124 each is more than two, the plurality of first conductive terminals 130 is received in the plurality of first portions 122 correspondingly. The plurality of first portions 122 are plugged to the plurality of second portions 124 correspondingly. The plurality of third conductive terminals 400 is received the plurality of second portions 124 correspondingly. The plurality of second portions 124 are received in the first receiving groove 112 side by side. A number of the first contact sheets 222 is more than two, the plurality of first contact sheets 222 is arranged along a first direction and spaced from each other, the plurality of first conductive terminals 130 resists the plurality of first contact sheets 222 correspondingly. The plurality of third conductive terminals 400 and the plurality of first conductive terminals 130 are alternatively arranged, the plurality of third conductive terminals 400 resists the third contact sheet 600. As shown in FIG. 7, a number of the third portions 322, the second conductive terminals 330, the fourth conductive terminals 500, and the fourth portions 324 each is more than two. The plurality of second conductive terminals 330 is received in the plurality of third portions 322, the plurality of third portions 322 is plugged to the plurality of fourth portions 324, the plurality of fourth conductive terminals 500 is received in the plurality of fourth portions 324 correspondingly. The plurality of fourth portions 324 is received in the second receiving chamber 312 side by side. A number of the second conductive sheets 224 is more than two, the plurality of second conductive sheets 224 is arranged along the first direction and spaced from each other. The plurality of second conductive terminals 330 resists the plurality of second contact sheets 224 correspondingly. The plurality of fourth conductive terminals 500 and the plurality of second conductive terminals 330 are alternatively arranged, the plurality of fourth conductive terminals 500 resists the third contact sheet 600, enabling the connector 10 to transmit signals by multiple passages, and the transmission efficient of the connector 10 is enhanced.

As shown in FIG. 6, in the embodiment, the first case 110 defines a first receiving chamber 112 along a direction parallel to an axial direction of the second case 210. A number of the first portion 122 and the second portion 124 each is more than two, the plurality of second portions 124 are arranged in two rows in the first receiving chamber 112. The plurality of first portions 122 are plugged to the plurality of second portions 124 correspondingly. The plurality of first conductive terminals 130 is received in the plurality of first portions 122 correspondingly. The plurality of third conductive terminals 400 is received in the plurality of second portions 124 correspondingly. The plurality of first conductive terminals 130 resists the plurality of first contact sheets 222 correspondingly. The plurality of third conductive terminals 400 resists the third contact sheet 600. In other embodiments, the plurality of second portions 124 can also be aligned in a row or several rows in the first receiving groove 112.

As shown in FIG. 7, the third case 310 defines a second receiving chamber 312 along a direction parallel to an axial direction of the second case 210. A number of the second portion 322 and the fourth portion 324 each is more than two, the plurality of fourth portions 324 are arranged in two rows in the second receiving chamber 312. The plurality of third portions 322 are plugged to the plurality of fourth portions 324 correspondingly. The plurality of second conductive terminals 330 is received in the plurality of third portions 322 correspondingly. The plurality of fourth conductive terminals 500 is received in the plurality of fourth portions 324 correspondingly. The plurality of second conductive terminals 330 resists the plurality of second contact sheets 224 correspondingly. The plurality of fourth conductive terminals 500 resists the third contact sheet 600. In other embodiments, the plurality of third portions 322 can also be aligned in a row or a plurality of rows in the second receiving groove 312. Specifically, in the embodiment, a number of the first receiving grooves 112, the second receiving grooves 312, the containing hole 212 and the PCB board 220 (as shown in FIG. 8) each is two, the two first receiving groove 112 are defined on the first case 110 side by side, the two second receiving groove 312 are defined on the second case 210 side by side. Referring to FIG. 3 again, opposite ends of the two containing holes 222 are in communication with the latching groove 214. The two PCB boards 220 are received in the two containing holes 212 correspondingly, and the two PCB boards 220 are positioned opposite to each other. It can be understood that, in other embodiments, a number of the first receiving groove 112, the second receiving groove 212, the containing hole 212 and the PCB board 220 each can be one or more than two.

As shown in FIG. 3, in one embodiment, the connector 10 further includes a first conductive sheet 700 and a second conductive sheet 800. As shown in FIG. 6, the first conductive sheet 700 is positioned on the second portion 124, and the plurality of third conductive terminals 400 are electrically coupled to the first conductive sheet 700. As shown in FIG. 7, the second conductive sheet 800 is positioned on the fourth portion 324, and the plurality of fourth conductive terminals 500 are electrically coupled to the second conductive sheet 800. In the embodiment, referring to FIG. 3 again, the first conductive sheet 700 abuts against a surface of the second portion 124, to enable the plurality of third conductive terminals 400 to be electrically coupled to the first conductive sheet 700, ensuring a reliable grounding of the third conductive terminals 400. The second conductive sheet 800 abuts against a surface of the fourth portion 324, to enable the plurality of fourth conductive terminals 500 to be electrically coupled to the second conductive sheet 800, ensuring a reliable grounding of the fourth conductive terminals 500. In one embodiment, the connector 10 further includes a first shielding sheet 900 and a second shielding sheet 1100. As shown in FIG. 6, the first portion 122 defines a first groove 1222, the second portion 124 defines a second groove 1242, the first shielding sheet 900 is received in the first groove 1222 and the second groove 1242 respectively. As shown in FIG. 7, the third portion 322 defines a third groove 3222, the fourth portion 324 defines a fourth groove 3242, the second shielding sheet 1100 is received in the third groove 3222 and the fourth groove 3242 respectively, such that a reliable signal transmission can be ensured.

In one embodiment, a slidable displacement of the first conductive terminal 130 along the first direction on the first contact sheet 222 is denoted as S, 0.5 millimeters≤S≤1 millimeters. In the embodiment, the slidable distance of the first conductive terminal 130 along the first direction on the first contact sheet 222 is equal to a slidable distance of the first conductive terminal 130 along a direction parallel to the X axis direction, i.e. the slidable displacement of the second connecting member 200 along the X axis direction relative to the first connecting member 100. Specifically in the embodiment, the slidable displacement of the second connecting member 200 along the X axis direction relative to the first connecting member 100 is 0.7 millimeters, i.e. values of a slidable displacement of the second connecting member 200 relative to a left side and a right side of the first connecting member 100 both are 0.7 millimeters. It can be understood, the electrical components connected to opposite ends of the connector 10 allow a position deviation value of 0.7 millimeters along the X axis direction.

In one embodiment, a cross section of the containing hole 212 has a shape which shrinks from opposite ends toward a middle portion, and can allow a deflection of opposite ends of the PCB board in a range. In one embodiment, a slidable distance of the third connecting member 300 along the third direction on the second case 210 is denoted as d, 0.5 millimeters≤d≤1 millimeters. In the embodiment, a slidable distance of the third connecting member 300 along the Y axis direction relative to the second connecting member 200 is equal to the slidable distance of the third connecting member 300 along the third direction on the second case 210. Specifically in the embodiment, a slidable displacement of the third connecting member 300 along the Y axis direction relative to the second connecting member 200 is 0.7 millimeters, i.e. values of slidable displacements of the third connecting member 300 relative to an upper side and a lower side of the second connecting member 200 both are 0.7 millimeters. It can be understood, the electrical components connected to opposite ends of the connector 10 allow a position deviation value of 0.7 millimeters along the Y axis direction.

In one embodiment, a slidable displacement of the second conductive terminal 330 along the second direction on the second contact sheet 224 is denoted as L, 1.0 millimeters≤L≤3 millimeters. In the embodiment, a slidable displacement of the second conductive terminal 330 along a direction parallel to the Z axis direction is equal to the slidable displacement of the second conductive terminal 330 along the second direction on the second contact sheet 224, i.e. a sidable displacement of the third connecting member 300 along the Z axis direction relative to the second connecting member 200. Specifically in the embodiment, a sidable displacement of the third connecting member 300 along the Z axis direction relative to the second connecting member 200 is 2.0 millimeters, i.e. the value of the slidable displacement of the third connecting member 300 towards or away from the second connecting member 200 is 2.0 millimeters. It can be understood, the electrical components connected to opposite ends of the connector 10 allow a position deviation value of 2.0 millimeters along the Z axis direction Technical features of above embodiments can be combined arbitrary, for simple, any combination of every technical feature in above embodiments is not all illustrated. However, the technical features which are not contradicted to each other may fall into the scope of the specification.

The above are several embodiments of the present invention described in detail, and should not be deemed as limitations to the scope of the present invention. It should be noted that variations and improvements will become apparent to those skilled in the art to which the present invention pertains without departing from its spirit and scope. Therefore, the scope of the present invention is defined by the appended claims.

What is claimed is:

1. A connector, comprising:

a first connecting member comprising a first case, a first insulator, and a first conductive terminal, wherein the first case defines a first receiving chamber therein, the first insulator is received in the first receiving chamber, and the first conductive terminal is received in the first insulator, the first case is provided with a first step on an external sidewall thereof;

a second connecting member comprising a second case and a PCB board, wherein the second case defines a containing hole, the PCB board is received in the containing hole, a first end and a second end of the second case each defines a latching groove, the latching grooves is in communication with the containing hole, opposite ends of the PCB board are provided with a first contact sheet and a second contact sheet, the first step is received in the latching groove of the first end, the first conductive terminal resists the first contact sheet, and the first conductive terminal is capable of sliding along a X axis direction on the first contact sheet; and a third connecting member comprising a third case, a second insulator, and a second conductive terminal, wherein the third case defines a second receiving chamber therein, the second insulator is received in the second receiving chamber, and the second conductive terminal is received in the second insulator, an external sidewall of the third case is provided with a second step, the second step is received in the latching groove of the second end, and the second conductive terminal resists the second contact sheet, and the second conductive terminal is capable of sliding along a Z axis direction on the second contact sheet, the third connecting member is capable of sliding along a Y axis direction on the second case, wherein the X axis direction, the Y axis direction and the Z axis direction are perpendicular to each other.

2. The connector according to claim 1, further comprising a third conductive terminal, a fourth conductive terminal, and a third contact sheet;

wherein the first insulator comprises a first portion and a second portion, the first portion is plugged to the second portion, the first conductive terminal is received in the first portion, the third conductive terminal is received in the second portion;

the second insulator comprises a third portion and a fourth portion, the third portion is plugged to the fourth portion, the second conductive terminal is received the third portion, the third conductive terminal is received the fourth portion; and the third contact sheet is positioned on the PCB board, the first contact sheet, the second contact sheet, and the third contact sheet are positioned on a same side surface of the PCB board, and separation distances are provided between the first contact sheet and the third contact sheet, between the second contact sheet and the third contact sheet, the third conductive terminal and the fourth conductive terminal both resist the third contact sheet.

3. The connector according to claim 2, wherein a number of the third contact sheet is two, the two third contact sheets are positioned on opposite sides of the PCB board, respectively;

the third conductive terminal comprises two first terminal units positioned on the second portion and opposite to each other, the two first terminal units clamp the PCB board, and the two first terminal units resist the two third contact sheets correspondingly;

the fourth conductive terminal comprises two second terminal units positioned on the fourth portion and opposite to each other, the two second terminal units clamp the PCB board, and the two second terminal units resist the two third contact sheets correspondingly.

4. The connector according to claim 2, wherein a number of the first portions, the first conductive terminals, the third conductive terminals, and the second portions each is more than two, the plurality of first conductive terminals is received in the plurality of first portions correspondingly, the plurality of first portions are plugged to the plurality of second portions correspondingly, the plurality of third conductive terminals is received in the plurality of second portions correspondingly, the plurality of second portions are received in the first receiving groove side by side;

a number of the first contact sheets is more than two, the plurality of first contact sheets is arranged along the X axis direction and spaced from each other, the plurality of first conductive terminals resists the plurality of first contact sheets correspondingly, the plurality of third conductive terminals and the plurality of first conductive terminals are alternatively arranged, and the plurality of third conductive terminals resists the third contact sheet;

a number of the third portions, the second conductive terminals, the fourth conductive terminals, and the fourth portions each is more than two, the plurality of second conductive terminals is received in the plurality of third portions, the plurality of third portions is plugged to the plurality of fourth portions, the plurality of fourth conductive terminals is received in the plurality of fourth portions correspondingly, the plurality of fourth portions is received in the second receiving chamber side by side;

a number of the second conductive sheets is more than two, the plurality of second conductive sheets is arranged along the X axis direction and spaced from each other, the plurality of second conductive terminals resists the plurality of second contact sheets correspondingly, the plurality of fourth conductive terminals and the plurality of second conductive terminals are alternatively arranged, the plurality of fourth conductive terminals resists the third contact sheet.

5. The connector according to claim 4, further comprising a first conductive sheet and a second conductive sheet, wherein the first conductive sheet is positioned on the second portion, and the plurality of third conductive terminals are electrically coupled to the first conductive sheet, the second conductive sheet is positioned on the fourth portion, and the plurality of fourth conductive terminals are electrically coupled to the second conductive sheet.

6. The connector according to claim 2, further comprising a first shielding sheet and a second shielding sheet;

wherein the first portion defines a first groove, the second portion defines a second groove, the first shielding sheet is received in the first groove and the second groove respectively;

the third portion defines a third groove, the fourth portion defines a fourth groove, the second shielding sheet is received in the third groove and the fourth groove respectively.

7. The connector according to claim 1, wherein a slidable displacement of the first conductive terminal along the X axis direction on the first contact sheet is denoted as S, 0.5 millimeters≤S≤1 millimeters.

8. The connector according to claim 1, wherein a cross section of the containing hole has a shape which shrinks from opposite ends toward a middle portion.

9. The connector according to claim 1, wherein a slidable displacement of the third connecting member along the Y axis direction on the second case is denoted as d, 0.5 millimeters≤d≤1 millimeters.

10. The connector according to claim 1, wherein a slidable displacement of the second conductive terminal along the Z axis direction on the second contact sheet is denoted as L, 1.0 millimeters≤L≤3 millimeters.

11. A connector, comprising:

a first connecting member comprising a first case, a first insulator, and a first conductive terminal, wherein the first case defines a first receiving chamber therein, the first insulator is received in the first receiving chamber, and the first conductive terminal is received in the first insulator, the first case is provided with a first step on an external sidewall thereof;

a second connecting member comprising a second case and a PCB board, wherein the second case defines a containing hole, the PCB board is received in the containing hole, a first end and a second end of the second case each defines a latching groove, the latching grooves is in communication with the containing hole, opposite ends of the PCB board are provided with a first contact sheet and a second contact sheet, the first step is received in the latching groove of the first end, the first conductive terminal resists the first contact sheet, and the first conductive terminal is capable of sliding along a X axis direction on the first contact sheet; and a third connecting member comprising a third case, a second insulator, and a second conductive terminal, wherein the third case defines a second receiving chamber therein, the second insulator is received in the second receiving chamber, and the second conductive terminal is received in the second insulator, an external sidewall of the third case is provided with a second step, the second step is received in the latching groove of the second end, and the second conductive terminal resists the second contact sheet, and the second conductive terminal is capable of sliding along a Z axis direction on the second contact sheet, the third connecting member is capable of sliding along a Y axis direction on the second case, wherein the X axis direction, the Y axis direction and the Z axis direction are perpendicular to each other, and wherein the X, Y, Z directional movement enables design deviations so that the connector is capable of tolerating stress.

* * * * *